US008338360B2

(12) United States Patent
Aouad

(10) Patent No.: US 8,338,360 B2
(45) Date of Patent: Dec. 25, 2012

(54) FABRIC CONDITIONING FABRIC CARE ARTICLES COMPRISING A PARTICULATE LUBRICANT AGENT

(75) Inventor: Yousef Georges Aouad, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 245 days.

(21) Appl. No.: 12/846,077

(22) Filed: Jul. 29, 2010

(65) Prior Publication Data

US 2011/0028380 A1 Feb. 3, 2011

Related U.S. Application Data

(60) Provisional application No. 61/229,753, filed on Jul. 30, 2009.

(51) Int. Cl.
*C11D 7/02* (2006.01)

(52) U.S. Cl. ..... 510/519; 510/520

(58) Field of Classification Search ..... 510/519, 510/520

See application file for complete search history.

(56) References Cited

U.S. PATENT DOCUMENTS 3,989,631 A 11/1976 Marsan
4,055,248 A 10/1977 Marsan
4,915,856 A 4/1990 Jamison
5,063,184 A 11/1991 Tsuyoshi et al.
5,292,529 A * 3/1994 Gregory et al. ..... 424/59
5,332,513 A 7/1994 Doms et al.
5,425,887 A 6/1995 Lam et al.
5,474,691 A * 12/1995 Severns ..... 510/516
6,133,226 A 10/2000 Knowlton et al.
6,436,895 B1 8/2002 Hsu et al.
6,458,343 B1 * 10/2002 Zeman et al. ..... 424/63
6,604,297 B2 8/2003 Hagemann et al.
6,660,241 B2 12/2003 Clere et al.
6,787,510 B2 9/2004 Santos et al.
7,341,702 B2 3/2008 Pultz, Jr. et al.
7,445,797 B2 11/2008 Meneghetti et al.
2003/0195130 A1 10/2003 Lentsch et al.
2004/0071742 A1 4/2004 Popplewell et al.
2004/0167056 A1 8/2004 Lentsch et al.
2007/0270327 A1 11/2007 Beck et al.
2008/0311206 A1 * 12/2008 Student et al. ..... 424/489

OTHER PUBLICATIONS

International Search Report for International Appl. Serial No. PCT/US2010/043690, mailed Oct. 25, 2010.

* cited by examiner

*Primary Examiner* — John Hardee
(74) *Attorney, Agent, or Firm* — Gary J. Foose

(57) ABSTRACT

A fabric conditioning articles containing a particulate lubricant agent comprising a platelet which is optionally hexagonal in shape, said platelet optionally having a planar aspect ratio of particle size to thickness of from about 50 to about 300. Non-limiting examples of suitable particulate lubricant agents can include materials such as a boron nitride, a tungsten disulfide, a molybdenum disulfide, a polytetrafluorethylene (PTFE), a talc, a calcium fluoride, a cerium fluoride and a tungsten disulfide, and a mixture thereof.

18 Claims, No Drawings

FABRIC CONDITIONING FABRIC CARE ARTICLES COMPRISING A PARTICULATE LUBRICANT AGENT

CROSS REFERENCE TO RELATED APPLICATION

This application claims the benefit of U.S. Provisional Application Ser. No. 61/229,753, filed on Jul. 30, 2009.

BACKGROUND OF THE INVENTION

Consumers are continually expressing the desire to not only have scent experiences on their fabrics but are becoming more discriminating as to the range of different fabric feel benefits they desire. Current fabric softeners, especially dryer sheets, fall short of fulfilling this consumer need. Many fabric softener sheets leave a dry, fluffy feeling on fabric whereas some users would prefer a "silky" feel. There is a continuing need to provide a fabric conditioning article that provide a suitable scent experience but also a different fabric feel benefit not provided by those dryer sheet products currently in the marketplace. Numerous attempts to provide dryer sheets are known. See, e.g., U.S. Patent Publ. No. 2007/0270327A1; U.S. Pat. Nos. 6,133,226; 5,425,887; and 3,989,631.

Separately from the laundry field, the use of particulate lubricants has been used for lubrication of various mechanical applications as a material useful to reduce friction between two surfaces, such as for skis or moving mechanical parts such as in heavy machinery. Examples of some attempts to make particulate lubricants are described in U.S. Pat. Nos. 7,445,797; 7,341,702; 6,660,241; and 4,915,856. It is believed that although particulate lubricant ingredients have been used in machinery applications, these mechanical applications are believed to be non-analogous to laundry. Further, no attempt to use these ingredients in the laundry field is believed to have been pursued. Furthermore, it has been believed by some that the addition of particulate lubricants, which can be insoluble and/or hydrophobic in nature, would not be suitable for a laundry application due to the difficulty working with aqueous wash/rinse systems as well as wet fabrics post wash cycle. Additionally, it is believed that the addition of small particles into the automatic drying cycle would not be recommended as these particles could be expected to be lost out of the exhaust and hot air discharge.

SUMMARY OF THE INVENTION

One aspect of the present invention provides for a fabric conditioning article comprising a particulate lubricant agent comprising a platelet which is optionally hexagonal in shape. Nonlimiting examples of suitable particulate lubricants agent include: a boron nitride, a tungsten disulfide, a molybdenum disulfide, a polytetrafluorethylene (PTFE), a talc, a calcium fluoride, a cerium fluoride and a tungsten disulfide, and a mixture thereof. The fabric conditioning article can be a dryer sheet or a multi-use bar.

DETAILED DESCRIPTION OF THE INVENTION

The present invention relates, in part, on the discovery that a consumer relevant "feel" benefit is imparted to fabric treated with the particulate lubricant agent of the present invention versus current dryer sheet technology. Recent work to understand the performance of dryer sheets resulted in the identification of certain particulate lubricant agents of platelet shape which provide enhanced softening benefits when used on fabrics in the drying cycle. It has been found that the particulate lubricant agent not only imparts enhanced softness benefit but in some instances a "feel" on fabric is a surface lubricity often described by consumers as a silky, slippery type of softness. Additionally, the addition of the present particulate lubricant agent to dryer sheets is believed to provide a silky and slippery feel to the dryer sheet itself which can be desirable to some consumers.

In one embodiment of the present invention, the fabric conditioning article of the present invention comprises a fabric conditioning composition releasably affixed to a substrate. In one embodiment, the substrate is a fibrous sheet, a film, or a combination thereof which can be laminated together to form a multi-layer substrate. In one embodiment, the fabric conditioning composition is at least partially coated upon the substrate. In another embodiment, the fabric conditioning composition is at least partially contained within any interstitial spaces or void areas within the substrate, such as where the substrate is a sheet made of fibrous material. In another embodiment, where the substrate is a film, the substrate can be at least partially coated with said fabric conditioning agent. A "fabric conditioning composition" is herein defined as a composition that imparting one or more fabric care benefits such as softening, freshness or perfuming, anti-static, color protection, etc., to fabrics, and/or imparting desirable tactile feel or appearance to the article. In another embodiment, the fabric conditioning article is a solid dyer-added bar which can be suitable for a multi-use application.

In one embodiment, the fabric conditioning composition comprises a particulate lubricant. In another embodiment, the fabric conditioning composition further comprises a perfume microcapsule, neat perfume, or mixtures thereof. In yet another embodiment, the fabric conditioning composition further comprises a fabric softening active, an antistatic agent, or mixtures thereof. In yet another embodiment, the fabric conditioning composition further comprises adjunct ingredients. Preferably the fabric conditioner composition has a melt temperature between about 30° C. and about 120° C., or from about 50° C. to about 100° C., or from about 70° C. to about 80° C. A composition having this melt temperature is preferred such that it will be able to melt when in use in a conventional tumble drying machine.

1. Particulate Lubricant Agent

In one embodiment, the present invention comprises from about 0.1% to about 10%, or from 0.5% to about 7.5%, or from about 1% to about 5% by weight of a particulate lubricant.

The particulate lubricant agent of the present invention comprises a platelet. In one embodiment, the platelet has a hexagonal shape, similar to that of graphite. In another embodiment the platelet has a planar aspect ratio of particle size to thickness of from about 50, or from about 80, or from about 100, or from about 150, or from about 200, or from about 250, or from about 275, up to and optionally including about 300. In one embodiment, the planar aspect ratio can even be above 300. The aspect ratio, as used herein, is determined by dividing the particle diameter by particle thickness. Particle diameter, as used herein, is a planar measurement of the longest lateral dimension of the platelet. In one embodiment, the platelet has a particle diameter of from about 1 micron to about 20 microns, alternatively from about 5 microns to about 15 microns, alternatively from about 10 to about 14 microns, alternatively about 12 microns. In one embodiment, the platelet has a thickness of from about 10 nm to about 50 nm, alternatively from about 20 nm to about 40 nm. In yet another embodiment, the platelet has a surface area of from about 20 $m^2/g$, or at least about 40 $m^2/g$, or at least about 60 $m^2/g$, or at least about 80 $m^2/g$, up to and optionally including to about 100 $m^2/g$. In one embodiment, the platelet surface area is above 100 $m^2/g$. Without intending to be bound by theory, it is believed that using a particulate lubricant having one or more of the above mentioned physical dimensions allows the platelet to be sufficiently thin with a large enough cross dimensional surface area to facilitate desirable softening benefits when used in a fabric treatment composition.

In one embodiment, the particulate lubricant comprises at least one of: a boron nitride, a tungsten disulfide, a molybdenum disulfide, a polytetrafluorethylene (PTFE), a talc, a calcium fluoride, a cerium fluoride and a tungsten disulfide, and a mixture thereof. One example of a born nitride is supplied by Momentive. Additional examples of suitable boron nitride platelets with suitable dimensions are provided in U.S. Pat. Nos. 6,660,241 B and 5,063,184 B. In one embodiment, the platelet comprises boron nitride and has an aspect ratio of from about 50 to about 300. Hexagonally shaped boron nitride is well known, as explained in U.S. Pat. No. 6,660,241, col. 2, lines 25-43, and in FIG. 1. Generally speaking, it is believed that the boron nitride particles form platelets. Stacked boron nitride platelets are believed to be held together only by Van der Waals forces, which are relatively weak. When a shearing force greater than the weak Van der Waals force is imparted across of the surface planes of platelets, the weak Van der Waals force is overcome and the platelets slide relative to each other, like a stack of playing cards. The relative ease with which these platelets slide against each other may be one of the reasons for the high lubricity of the particulate lubricant when imparted on fabrics. In one embodiment, the platelet is substantially insoluble in water, meaning that the platelet remains in substantially the same solid state if contacted in an aqueous bath for up to 24 hours at standard ambient conditions and 25° C., or even up to 120° C. In another embodiment, the platelet is made of a hydrophobic material.

In another embodiment, the particulate lubricant agent comprises a platelet made of boron nitride of high purity and high thermal conductivity made by reacting an oxygen containing boron compound with a nitrogen containing source in the presence of a dopant at a temperature of at least 1000 C for at least one hour, wherein the dopant is a metal containing compound that forms metal borate with a vaporizing temperature that is lower than the highest processing temperature, as described in U.S. Pat. No. 7,341,702 B.

Additional materials which can be used to form suitable platelets for use in the present invention include, but are not limited to, those selected from the group consisting of copper, lead, antimony, zinc, bismuth, tin, aluminum, magnesium, selenium, arsenic, cadmium, tellurium, graphite, and alloys thereof, and mixtures there. In one embodiment, where the particulate lubricant agent comprises a platelet made of graphite, the composition can be targeted for darker fabrics such as denims and jeans. This is believed to be particularly desirable as it can make the dark fabrics appear less worn and newer.

Without intending to be bound by theory, it is believed that the particulate lubricant agent of the present invention provides for enhanced softness feel on treated fabrics. It is believed that the enhanced feel properties are due in part to the "sliding" feel obtained when rubbing the hand over the treated fabrics. The "sliding" feel is to result from the sliding of the platelets over the fibers of the fabric.

Further, without intending to be bound, it is believed that by incorporating the particulate lubricant agent into a fabric conditioning composition, there is a lower occurrence of loss of the particulate lubricant agents to the vented exhaust discharge when used in the automatic drying cycle. It is believed that the fabric conditioning composition helps increase deposition of the platelets onto the fabrics and helps at least temporarily adhering them to the fabrics throughout the drying process. It is believed that if the particulate lubricant agents were simply dosed into the wash or rinse or freely dispersed into the drying cycle that sufficient deposition onto the fabrics would not be achieved. As such, it has been importantly found that providing a fabric conditioning composition comprising the particulate lubricant system, sufficient deposition is achieved giving desirable fabric care benefits.

2. Perfumes

In one embodiment, the fabric conditioning article further comprises from about 0.1% to about 10%, or from about 1% to about 8%, or from about 3% to about 5% by weight of the fabric conditioning article of a perfume. In one embodiment, perfume comprises at least one of a perfume microcapsule, a neat perfume, or a mixture thereof.

a. Perfume Microcapsules

In one additional embodiment, the fabric conditioning sheet further comprises a friable perfume microcapsule. The term "microcapsule" is used herein the broadest sense and includes the encapsulation of perfume or other materials or actives in small capsules (i.e., microcapsules), typically having a diameter less than 300 microns. Typically, these microcapsules comprise a spherical hollow shell of water insoluble material, typically polymer material, within which the active material, such as perfume, is contained. Microcapsules are described in the following references: US 2003/215417 A1; US 2003/216488 A1; US 2003/158344 A1; US 2003/165692 A1; US 2004/071742 A1; US 2004/071746 A1; US 2004/072719 A1; US 2004/072720 A1; EP 1,393,706 A1; US 2003/203829 A1; US 2003/195133 A1; US 2004/087477 A1; US 2004/0106536 A1; U.S. Pat. No. 6,645,479; U.S. Pat. No. 6,200,949; U.S. Pat. No. 4,882,220; U.S. Pat. No. 4,917,920; U.S. Pat. No. 4,514,461; U.S. RE 32,713; U.S. Pat. No. 4,234,627.

Microcapsules may be prepared using a range of conventional methods known to those skilled in the art for making shell capsules, such as Interfacial polymerization, and polycondensation. See e.g., U.S. Pat. No. 3,516,941, U.S. Pat. No. 4,520,142, U.S. Pat. No. 4,528,226, U.S. Pat. No. 4,681,806, U.S. Pat. No. 4,145,184; GB 2,073,132; WO 99/17871; and MICROENCAPSULATION: Methods and Industrial Applications Edited by Benita and Simon (Marcel Dekker, Inc. 1996). It is recognized; however, that many variations with regard to materials and process steps are possible. Non-limiting examples of materials suitable for making shell of the microcapsule include urea-formaldehyde, melamine-formaldehyde, phenol-formaldehyde, gelatin, polyurethane, polyamides, or mixtures or combinations thereof.

In one embodiment of the invention, the shell of the microcapsules comprises an aminoplast resin. A method for forming such shell capsules includes polycondensation. Aminoplast resins are the reaction products of one or more amines with one or more aldehydes, typically formaldehyde. Non-limiting examples of suitable amines include urea, thiourea, melamine and its derivates, benzoguanamine and acetoguanamine and combinations of amines. Suitable cross-linking agents (e.g., toluene diisocyanate, divinyl benzene, butanediol diacrylate etc.) may also be used and secondary wall polymers may also be used as appropriate, e.g. anhydrides and their derivatives, particularly polymers and co-polymers of maleic anhydride as disclosed in US 2004/0087477 A1. In another embodiment, the shell of the microcapsules comprises urea-formaldehyde; melamine-formaldehyde; or combinations thereof.

The microcapsules of the present invention, in one embodiment, are friable in nature. Friability refers to the propensity of the microcapsules to rupture or break open when subjected to direct external pressures or shear forces. For purposes of the present invention, the microcapsules utilized are "friable" if, while attached to fabrics treated therewith, they can be ruptured by the forces encountered when the capsule-containing fabrics are manipulated by being worn or handled (thereby releasing the contents of the capsule). In another embodiment, the microcapsule is a moisture-activated microcapsule such as beta-cyclodextrin. In yet another embodiment, the microcapsules are combinations of friable microcapsules and moisture-activated microcapsules.

In one embodiment, the shell capsules typically have a mean diameter in the range 1 micrometer to 100 micrometers, alternatively from 5 micrometers to 80 microns, alternatively from 10 micrometers to 75 micrometers, and alternatively between 15 micrometers to 50 micrometers. The particle size distribution can be narrow, broad or multimodal.

In another embodiment, microcapsules vary in size having a maximum diameter between about 5 microns and about 300 microns, alternatively between about 10 microns and about 200 microns. As the capsule particle size approaches 300 microns, e.g. 250 microns), a reduction in the number of capsules entrained in the fabric may be observed.

In another embodiment, the capsules utilized in the present invention generally have an average shell thickness ranging from about 0.1 micron to 50 microns, alternatively from about 1 micron to about 10 microns.

Suppliers of microcapsules may include International Flavors & Fragrances (IFF), Quest International (Quest) via Reed Pacific, and Appleton. An example of a suitable microcapsule for purposes of the present invention includes Perfume Microcapsules (PMCs) from Appleton. Other examples may include WIZARD from Reed Pacific, and EVERLAST from IFF. For a preferred embodiment, the shell is formed by cross-linking aldehydes and amine functionalities. In one embodiment, the encapsulated blooming perfume composition may, in one embodiment, comprise from about 3 to about 300 different perfume ingredients, preferably with minimal modifiers which include viscosity or hydrophobicity modifiers. Typical viscosity modifiers include, but not limited to, silicone oil, gums, and waxes. Typical hydrophobic modifiers include, but not limited to, isopropyl myristate, mineral oil, dipropylenemethyl ether (DPM). Such modifiers may be used at less than 50%, alternatively less than 40%, alternatively less than 30%, alternatively less than 20%, alternatively less than 10%, alternatively less than 5%, alternatively less than 1%, alternatively about 0%, alternatively at least 0.1% but not greater than 50%, by weight of total perfume composition. Without wishing to be bound by theory, the overuse of modifiers reduces the efficiency of the scent experience imparted by the perfume microcapsules of the present invention.

The friable microcapsules of the present invention are distinguished from moisture-activated microcapsules, such as those capsules comprising of cyclodextrin that burst upon contact with moisture; a wax comprising microcapsule such as those described in U.S. Pat. No. 5,246,603; and starch-based microcapsule also described in U.S. Pat. No. 5,246,603.

In one embodiment, the PMC encapsulates "blooming" perfume ingredients. Non-limiting examples of blooming perfume ingredients that are useful in the articles of the present invention are given in U.S. Pat. Pub. No. 2005/0192207 A1, published Sep. 1, 2005, ¶¶29-31. Other perfume ingredients that may be encapsulated by the microcapsules of the present invention include those described in U.S. Pat. Pub. No. 2005/0192207 A1, published Sep. 1, 2005, ¶36. Non limiting examples of suitable blooming perfumes are described in U.S. Patent Publ. 2007/0179082A1 and 2005/0192207A1. In one embodiment, at least about 25%, or at least 40% or at least 50%, or at least 65%, or at least 75%, by weight of the perfume composition, comprises perfume ingredients having a boiling point equal or lower than about 250° C., alternatively lower than about 240 C. Additionally, the perfume used herein can include a low volatile perfume as defined in 2005/0192204A1.

b. Amount of PMC

One aspect of the present invention provides from about 10 mg to about 100 mg of perfume encapsulated by the PMC in a single use dryer sheet. Alternatively, the article comprises from about 40 mg to about 100 mg, or 65 mg to about 100 mg, or 70 mg to about 100 mg of perfume encapsulated by the friable PMC of the present invention. Multiple use articles (those articles that can be used more than once in a dryer) will have much more encapsulated PMC; however, these multiple use article will deposit from about 8 mg to about 80 mg of perfume encapsulated by PMC to laundry per dryer. An example of a multiple use article include those described in U.S. Pat. Appl. No. 2003/0195130 A1.

It is observed that dyer sheets comprising friable PMC, deliver about 80% of the PMC to fabric in an unburst form, by weight of unburst PMC contained in the dryer sheet. The amount of actual microcapsules will depend on a number factors, including the perfume loading of the PMC (how much perfume can be encapsulated by the PMC0, the size and type of friable microcapsule, and what the efficiency is the article to deliver friable PMC to fabric during a drying cycle. A dryer sheet is typically about 58 inches$^2$.

There are a number of ways of calculating the amount of perfume encapsulated by PMC. One such method includes a solvent extraction approach. In such an approach, the coating of the dryer sheet is extracted from the substrate (e.g., non-woven sheet) with a warm solvent suitable for such extraction, including, but not limited to a solution of isopropanol, hexane, methanol, or combinations thereof. Multiple extractions may be needed. The extract is dried and weighed. The extracted sheet is also weighed. The difference in sheet weight before and after extraction is the coating weight. Thereafter, the extract is filtered to isolate the PMC. The isolated PMC is dried and weighed. The weight of the isolated PMC divided by the weight of the coating mix multiplied by 100 is the % of PMC in the coating mix. The use of gas chromatography/mass spectrometry can confirm the presence and identify perfume encapsulated by the microcapsule. In turn the presence of the microcapsule can be confirmed with the use of scanning electron microscopy. Infrared (IR) may be suitable to identify the composition of the shell of the microcapsule. Other perfume encapsulating technologies can also be used in the present invention, such as the perfume particles described in U.S. Patent Pub. 2005/079991 paragraphs 48-115; U.S. Pat. No. 6,787,510 describing suitable perfumed particles having porous inorganic carrier particles and a perfume composition absorbed and/or adsorbed on said carrier particles;

c. Different Blooming Perfume Composition within the PMCs

One aspect of the invention provides for a fabric conditioning article comprising a perfume microcapsule of the present invention encapsulating more than one type of perfume compositions. For example, one embodiment of the invention provides for an article that comprises both a first microcapsule encapsulating a first blooming perfume composition and a second microcapsule encapsulating a second blooming perfume composition, wherein the first blooming perfume composition is different from the second blooming perfume composition. Another embodiment provides yet a third microcapsule encapsulating a third blooming perfume composition, wherein the third blooming perfume composition is different from the first and second blooming perfume compositions. By providing different blooming perfume compositions within the same fabric conditioning article, the consumer can experience multiple scent types within the same article which allows for a more holistic product experience. By separating these blooming perfume compositions this holistic product experience may not have otherwise be achieved if some of the perfume ingredients in the respective blooming perfume compositions are not compatible with each other—at least in the encapsulation environment of the perfume microcapsule.

d. Neat Perfume in the Fabric Conditioning Composition

In one embodiment, the fabric conditioning composition comprises a neat perfume. Neat perfume, as defined herein means any perfume ingredient which is not encapsulated but can be freely present within the fabric conditioning composition. In one embodiment the neat perfume can be any of the perfume ingredients which are disclosed as being suitable for the perfume within the capsule, such as blooming perfumes or low volatile perfumes, or combinations thereof.

In one embodiment, the fabric conditioning composition further comprises a pro-perfume or pro-fragrant material such as described in U.S. Pat. No. 6,277,796 (describing pro-fragrant acetals); and U.S. Patent Pub. 2005/079991_at paragraphs 103-115 (describing various perfume ingredients and pro-fragrants including ketals and esters). The pro-perfume or pro-fragant can be in the neat perfume, can be encapsulated, or can be used in a additional suitable perfume technology.

Additional suitable perfume technologies are commonly used in fabric conditioning articles such as dryer sheets. Non limiting examples of suitable perfume technologies for use herein include perfume/cyclodextrin complexes such as described in U.S. Pat. Nos. 5,102,564; 5,094,761 (describing suitable perfume/cyclodextrin complexes and clay); U.S. Pat. No. 5,552,378 (describing suitable sizes for perfume/cyclodextrins which can be used herein); and U.S. Pat. No. 5,681,806. Some of these perfume technologies are described in U.S. 2007/0275866A1.

3. Additional Fabric Conditioning Agents for Use in the Fabric Conditioning Composition The article of the present invention comprises a fabric conditioning composition, wherein said fabric conditioning composition comprises a particulate lubricant agent and optionally perfume which can include a perfume microcapsule, neat perfume, or a combination thereof. The fabric conditioning composition may comprise one or more additional fabric conditioning actives.

a. Fabric Softener and/or Antistatic Agents

Examples of fabric conditioning actives may include a fabric softening active and/or an antistatic active. As defined herein, the fabric conditioning composition does not include either the perfume or the particulate lubricant as described above. The fabric care composition may comprise from at least about 0.001% to about 90%, alternatively about 1% to about 80%, alternatively from about 10% to about 50%, alternatively from about 15% to about 40% of one or more fabric conditioning actives by weight of the fabric conditioning article. In turn, the fabric conditioning article may comprise from at least about 0.001% to about 90%, alternatively about 1% to about 80%, alternatively from about 10% to about 50%, alternatively from about 15% to about 40% of a fabric conditioning composition by weight of the fabric conditioning article.

The fabric softening actives can be one or a mixture of a quaternary ammonium compound, a tertiary amine and or its salts, an ethoxylated fatty material, a fatty acid, any fatty acid derivative, or a mixture thereof. Examples of fabric softening actives that may be useful in the articles are the compositions described in U.S. Pat. Nos. 4,103,047; 4,237,155; 3,686,025; 3,849,435; 4,073,996; and U.S. Pat. Publ. No. 2003/0195130, ¶¶14-17. In one embodiment the fabric softening active is a biodegradable quaternary ammonium such as described in U.S. Pat. No. 5,476,599.

In one embodiment, the fabric softening active is chosen from at least one of the following: a quaternary ammonium compound as one described in U.S. Pat. No. 6,787,510, col. 4, line 12 et seq.; or a tertiary amine, as described in id. at col. 7, line 31 et seq.; or a nonionic softening active, id. at col. 8, line 63 et seq.; or a fatty acid, id. at col. 10, line 63 et seq.; or combinations thereof. In another embodiment, the fabric softening active is chosen from one of the ester quaternary ammonium compounds described in Formulas I, II, or II and/or unsaturated fatty acids disclosed in U.S. Pat. No. 5,503,756, and/or one of the of the diester quaternary ammonium compounds and/or sorbitan esters disclosed in U.S. Pat. No. 6,169,067.

b. Formaldeyde Scavengers

One aspect of the invention provides for a composition comprising a formaldehyde scavenger. The term "formaldehyde scavenger" is used herein the broadest sense to include any compound that reduces the level of free formaldehyde in a composition of the present invention, provided the formaldehyde scavenger is safe for humans and does not include ammonia, ethylene urea, tryptophan, 5-hydroxytryptophan, hydroxyl amine, hydroxylamine sulfate, barbituric acid.

This aspect of the present invention is based, in part, upon the discovery that the use of certain formaldehyde scavengers in fabric care compositions, particularly those fabric care compositions that comprise microcapsules (e.g., PMC), may reduce the level of free formaldehyde in the composition. Without wishing to be bound by theory, free formaldehyde may be emitted by the use of certain microcapsules over time. It is thought that the shell material used to manufacture the shell of the microcapsule may be responsible for the formation of free formaldehyde. For example, these shell materials include melamine-formaldehyde, urea-formaldehyde, phenol-formaldehyde, or other condensation polymers with formaldehyde. Nevertheless formaldehyde based resins such as melamine-formaldehyde or urea-formaldehyde resins are especially attractive for perfume encapsulation due to their wide availability and reasonable cost. However, these microcapsules may emit formaldehyde. There is a need to minimize the emission or potential emission of free formaldehyde.

The term "free formaldehyde" means those molecular forms in aqueous solution capable of rapid equilibration with the native molecule, i.e., $H_2CO$, in the headspace over the solution. This includes the aqueous native molecule; its hydrated form (methylene glycol; ($HOCH_2OH$)); and its polymerized hydrated form ($HO(CH_2O)_nH$). These are described in detail in a monograph by J. F. Walker (Formaldehyde ACS Monograph Series No. 159 3rd Edition 1964 Reinhold Publishing Corp.).

Any art-accepted method may be used to determine the amount or moles of free formaldehyde (in the perfume microcapsule composition or in the fabric care composition). Other methods may include the EPA method EPA 8315A, Determination of Carbonyl Compounds by High Performance Liquid Chromatography, and High-Performance Liquid Chromatographic Determination of Free Formaldehyde in Cosmetics Preserved with Dowicil 200, *Journal of Chromatography,* 502 (1990), pages 193-200. One example includes the following: formaldehyde is analyzed by means of room temperature derivatization with 2,4 dinitrophenyl hydrazine (DNPH) prior to a chromatographic separation using Reversed Phase Chromatography with UV/Visible spectrophotometric detection (wavelength setting at 365 nm). Calibration is performed through "External Standard calibration" with reference formaldehyde solution made up from commercially available 36-37% formaldehyde solution. Activity of the formaldehyde standard material can be determined via redox titration.

In one embodiment, the formaldehyde scavenger is chosen from: sodium bisulfite, urea, cysteine, cysteamine, lysine, glycine, serine, carnosine, histidine, glutathione, 3,4-diaminobenzoic acid, allantoin, glycouril, anthranilic acid, methyl anthranilate, methyl 4-aminobenzoate, ethyl acetoacetate, acetoacetamide, malonamide, ascorbic acid, 1,3-dihydroxyacetone dimer, biuret, oxamide, benzoguanamine, pyroglutamic acid, pyrogallol, methyl gallate, ethyl gallate, propyl gallate, triethanol amine, succinamide, thiabendazole, benzotriazol, triazole, indoline, sulfanilic acid, oxamide, sorbitol, glucose, cellulose, poly(vinyl alcohol), poly(vinyl amine), hexane diol, ethylenediamine-N,N'-bisacetoacetamide, N-(2-ethylhexyl)acetoacetamide, N-(3-phenylpropyl)acetoacetamide, lilial, helional, melonal, triplal, 5,5-dimethyl-1,3-cyclohexanedione, 2,4-dimethyl-3-cyclohexenecarboxaldehyde, 2,2-dimethyl-1,3-dioxan-4,6-dione, 2-pentanone, dibutyl amine, triethylenetetramine, benzylamine, hydroxycitronellol, cyclohexanone, 2-butanone, pentane dione, dehydroacetic acid, chitosan, or a mixture thereof. In another embodiment, the ketoester or ketoamide is chosen from a β-ketoester or a β-ketoamide, respectively. Non-limiting examples include ethyl acetoactamide or methyl acetoacetate ester (Aldrich). Another example includes 16-diketene sizing agents (the diketene can ring open with any alcohol to yield a ketoester) such as those from Hercules. In yet another embodiment, the amount of scavenger in the fabric care composition comprises from about 0.01% to about 0.8%, alternatively from about 0.03% to about 0.4%, alternatively from about 0.065% to about 0.25%, by weight of the fabric conditioning composition. Further details of formaldehyde scavengers are described in U.S. patent application Ser. No. 11/351,718, filed Feb. 10, 2006 (P&G Case 10301).

c. Optional Components

The fabric conditioning composition may further comprise optional components used in textile treatment compositions including one or more of the following: odor control agents, cyclodextrins, cyclodextrin perfume complexes, soil release polymer, anti-oxidants, colorants, preservatives, optical brighteners, opacifiers, stabilizers such as guar gum and polyethylene glycol, anti-shrinkage agents, anti-wrinkle agents, soil release agents, fabric crisping agents, reductive agents, spotting agents, germicides, fungicides, anti-corrosion agents, antifoam agents, and the like. In one embodiment, the fabric conditioning composition is free or substantially free of any one or more of the above-identified optional components. Additional examples of optional components which can be used in the fabric conditioning composition include color care agents as described in U.S. Pat. No. 5,804,547; polyamines as described in U.S. Pat. No. 6,143,713.

4. Fabric Conditioning Articles

The fabric conditioning article of the present invention is designed to deliver fabric conditioning agents, such as the particulate lubricant, for use in an automatic laundry dryer. The term "fabric conditioning article" is used herein in the broadest sense to include any article that is suitable to delivering fabric care benefits such as softening or freshness to fabric in an automatic laundry drying machine.

Non-limiting examples of fabric conditioning articles include those described in U.S. Pat. Nos. 4,000,340; 4,055,248; 4,073,996; 4,022,938; 4,764,289; 4,808,086; 4,103,047; 4,014,432; 3,701,202; 3,634,947; 3,633,538; 3,435,537; 6,604,297; and 6,787,510. See also International Patent Publication Nos.: WO 00/27991; and WO 00/65141.

a. Substrate

In one embodiment, the article comprises a substrate. An example of a substrate includes a sheet. The sheet may be made of a fibrous material and can be chosen from a paper, woven, or non-woven sheet, such as those described in U.S. Pat. No. 3,686,025. In one embodiment the substrate comprises a non-woven sheet. In one embodiment the non-woven sheet comprises polyethylene fibers, such as polyester fiber having a denier of from about 2 to about 6, said substrate having a basis weight of from about 0.52 oz/yd2 to about 0.58 oz/yd2, a thickness of from about 0.16 mm to about 0.22 mm. Examples of suitable non-woven sheet materials and methods of making are provided in: U.S. Pat. No. 5,470,492. A substrate comprising a sponge is yet another example. An example of a non-woven dryer sheet is one from BBA Fiber Web. A commercially available example of an article comprising a substrate and fabric conditioning composition includes a dryer sheet such as those sold under the trademark BOUNCE. In another embodiment, the fabric conditioning composition can be applied to a film material. Suitable film materials for use herein are described in U.S. Ser. No. 12/491,315 to Aouad et al. In one embodiment, the substrate comprises a three-dimensional textured substrate comprising a thermoplastic film. Suitable substrates can be single layer or multi layer sheets, films, or combinations thereof.

In one embodiment, the fabric care composition is disposed on the substrate (e.g., such as in a dryer sheet which can be non-woven material or a film). In an alternative embodiment, the article of the present invention comprises a fabric condition composition without a substrate. Examples include dispensing the fabric conditioning composition, through a dispenser affixed to the outside surface of the dryer or inside surface of the dryer barrel or inside door, or integral to the dryer itself.

One aspect of the present invention provides for a method of making a fabric conditioning article comprising the particulate lubricant as described above. In one embodiment, the method of making the fabric conditioning article comprises: providing a substrate in the form of a sheet; releasably affixing a fabric conditioner composition onto or into said substrate, said fabric conditioner composition comprising a particulate lubricant as described herein.

b. Multi-Use Fabric Conditioning Articles

Without intending to be bound, it is believed that dryer sheets are typically designed for single use applications. The article of the present invention can be used for such a single-use application but can also be used for multi-use applications, such as where making a multi use fabric conditioning composition, such as the Bounce® Dyer Bar. Another example of a commercially available dryer bar is the X-STATIC in-dryer fabric softening bar from Ecolab, Inc.

In one embodiment, fabric conditioning article is a multi-use dryer bar, the bar comprises the particulate lubricant agent of the present invention, optionally a perfume, and optionally a fabric softening and/or antistatic agent, which in turn may comprise one or more fabric softener active(s).

Examples of suitable fabric softening and/or antistatic agents for use in the multi-use bar are described in US 2004/0167056 A1, paragraphs 0040-0047. One class of fabric softener actives includes cationic surfactants. Examples of cationic surfactants include quaternary ammonium compounds. Exemplary quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof. One non-limiting example of a fabric softening active is DXP 5522-048 from Evonik Goldschimidt Corp. (comprising about 80 wt % ethanaminium, 2-hydroxy-N,N-bis(2-hydroxyethyl)-N-methyl, methyl sulfate (salt), octadecanoate (ester)). The remaining 20 wt % of DXP 5522-048 is proprietary to Evonik Goldschimidt Corp. In one embodiment, the fabric softening active comprises from about 41 wt % to about 61 wt %, alternatively from about 43% to about 53 wt %, alternatively from about 49 wt % to about 52 wt %, alternatively combinations thereof, of the bar composition (wherein the bar composition is free of any "hardware" or other such plastic components.)

The dryer bar composition may also comprise a carrier component, such as a wax, suitable for use in an automatic laundry dryer. Examples of a "carrier component" may include those described in US 2004/0167056 A1, paragraphs 0063-0069. One example of a carrier component includes ACRAWAX C from Lonza Inc., (which is a mixture of N,N'-Ethylenebisstearamide, N,N'-Ethylenebispalmitamide, and fatty acid ($C_{14}$-$C_{18}$) The wt % of the components of ACRAWAX C is proprietary to Lonza, Inc. In one embodiment, the carrier component comprises from about 38 wt % to about 55 wt %, alternatively from about 41% to about 53 wt %, alternatively from about 47 wt % to about 52 wt %, alternatively combinations thereof, of the bar composition (wherein the bar composition is free of any "hardware" or other such plastic components.)

The dryer bar composition may also comprise a perfume. Examples of perfume include blooming perfumes and low volatile perfumes, and those described in US 2005-0192207 A1; and U.S. Pat. No. 7,524,809. In one embodiment, perfume comprises from about 0 wt % to about 6 wt %, alternatively from about 1% to about 5 wt %, alternatively from about 2 wt % to about 4 wt %, alternatively combinations thereof, of the bar composition (wherein the bar composition is free of any "hardware" or other such plastic components.) A suitable supplier of perfume is Avenil. In one alternative, the dryer bar is substantially free or free of perfume. In yet another embodiment, the dryer bar composition is free or essentially free of a detersive surfactant (e.g., anionic detersive surfactant).

The term "dryer bar" is used in the broadest sense. The term "bar" refers to any solid form, chunk, slab, wedge, lump etc. comprising a fabric condition composition that is substantially solid at the operating temperature of an automatic clothes dryer. Non-limiting examples of dryer bar shapes include those of FIGS. 1a, 1b, 2c, 2b, 3a, 3b, 4a, and 4b of US 2004/0167056 A1; CA 1,021,559; and U.S. Pat. No. 3,736,668.

The term "multiple use" means the dry bar may be used in the dryer for more than one cycle. Non-limiting examples include 2, 4, 6, 8, 10 12, or more times. In one embodiment, the product can be used for about 2 months, alternatively 4 months, alternatively from about 1 month to about 5 months.

The raw materials that comprise the dryer bar composition and that are to be processed by the single screw extruder are provided in physical forms suitable for processing in a single screw extruder. Physical forms of the raw materials may include flakes, noodles, pellets, pastilles, and the like. Conventional equipment suitable for processing these physical forms in the extruder may include belt flakers, rotoformers, plodders, and the like.

6. Kits and Methods of Using

One aspect of the invention provides for a kit comprising an article of the present invention, optionally comprising instructions, wherein preferably the instructions instruct the user to administer the article inside an automatic laundry dryer. The kit can comprise a plurality of the same type of fabric conditioning article or can comprise a plurality of different types of fabric conditioning articles, wherein at least one of the fabric conditioning articles is in accordance with the present invention.

Another aspect of the invention provides for a method of treating fabric comprising the step of administering an article of the present invention into an automatic laundry dryer. Where the article is in the form of a dryer sheet, the step of administering can be performed before, after, or concurrently with a step of placing laundry into the drum of an automatic tumble dryer. In one embodiment the laundry has been washed and rinsed prior to placing into the drum. Where the article is in the form of a multi-use dryer bar, the article can be installed into the interior of the drum followed by multiple uses.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the DETAILED DESCRIPTION OF THE INVENTION are, in the relevant part, incorporated herein by reference; the citation of any document is not to be construed as an admission that it is prior art with respect to the present invention. To the extent that any meaning or definition of a term or in this written document conflicts with any meaning or definition in a document incorporated by reference, the meaning or definition assigned to the term in this written document shall govern.

Except as otherwise noted, the articles "a," "an," and "the" mean "one or more."

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric conditioning article comprising: from about 0.001% to about 90% by weight of the fabric conditioning article of a fabric conditioner composition having a melt temperature from about 30° C. to about 120° C., wherein said fabric conditioner composition comprises from about 0.1% to about 10% by weight of the fabric conditioning article of a particulate lubricant agent comprising a platelet, wherein the platelet comprises boron nitride with a particle size of from about 1 micron to about 20 microns, preferably 12 microns.

2. The fabric conditioning article of claim 1, wherein the particulate lubricant further comprises at least one of: a tungsten disulfide, a molybdenum disulfide, a polytetrafluorethylene (PTFE), a talc, a calcium fluoride, a cerium fluoride and a tungsten disulfide, and a mixture thereof.

3. The fabric conditioning article of claim 1, wherein the particulate lubricant further comprises at least one of a tungsten disulfide, a molybdenum disulfide, and a mixture thereof.

4. The fabric conditioning article of claim 1, wherein the platelet is hexagonal.

5. The fabric conditioning article of claim 4, wherein the platelet has a planar aspect ratio of particle size to thickness of from about 50 to about 300.

6. The fabric conditioning article of claim 4, wherein the platelet has a thickness of from about 10 nm to about 50 nm.

7. The fabric conditioning article of claim 4, wherein the platelet have a surface area of from about 20 m2/g to about 100 m2/g.

8. The fabric conditioning article of claim 1, wherein the fabric conditioning composition comprises from about 0.1% to about 10% by weight of the fabric conditioning article of a perfume.

9. The fabric conditioner article of claim 8, wherein the perfume is encapsulated.

10. The fabric conditioner article of claim 9, wherein the perfume is encapsulated in a friable shell comprising at least one of urea-formaldehyde, melamine-formaldehyde, phenol-formaldehyde, gelatin, polyurethane, polyamides, and a mixture thereof.

11. The fabric conditioning article of claim 1, wherein the fabric conditioning composition comprises from about 0.001% to about 90% by weight of the fabric conditioning article of a quaternary ammonium compound.

12. The fabric conditioning article of claim 11, wherein the quaternary ammonium compound comprises at least one of a quaternary ammonium compound, a tertiary amine and or its salts, an ethoxylated fatty material, a fatty acid, any fatty acid derivative, or a mixture thereof.

13. The fabric conditioning article of claim 1, wherein the fabric conditioning composition comprises from about 0.001% to about 90% by weight of the fabric conditioning article of an antistatic compound.

14. The fabric conditioning article of claim 1, further comprising from about 0.01% to about 0.8% of a formaldehyde scavenger.

15. The fabric conditioning article of claim 1, wherein the fabric conditioning composition releasably affixed to a substrate.

16. The fabric conditioning article of claim 15, where in the substrate is a non-woven sheet comprising a polyethylene fiber.

17. The fabric conditioning article of claim 1, wherein the article is a multi-use dryer bar.

18. A method of making the fabric conditioning article of claim 1 comprising:

a. providing a substrate in the form of a sheet; and b. releasably affixing a fabric conditioner composition onto or into said substrate, said fabric conditioner composition comprising a particulate lubricant agent comprising a platelet.

* * * * *